US008870028B2

(12) United States Patent
Kane et al.

(10) Patent No.: US 8,870,028 B2
(45) Date of Patent: Oct. 28, 2014

(54) DISPENSING DEVICE

(71) Applicant: Restek Corporation, Bellefonte, PA (US)

(72) Inventors: Thomas E. Kane, Port Matilda, PA (US); Brian A. Jones, Bellefonte, PA (US)

(73) Assignee: Restek Corporation, Bellefonte, PA (US)

( * ) Notice: Subject to any disclaimer, the term of this patent is extended or adjusted under 35 U.S.C. 154(b) by 37 days.

(21) Appl. No.: 13/738,175

(22) Filed: Jan. 10, 2013

(65) Prior Publication Data

US 2013/0317423 A1 Nov. 28, 2013

Related U.S. Application Data

(60) Provisional application No. 61/652,045, filed on May 25, 2012, provisional application No. 61/652,714, filed on May 29, 2012.

(51) Int. Cl.

| | |
|---|---|
| ***B67D 7/70*** | (2010.01) |
| ***B65D 83/00*** | (2006.01) |
| ***B01F 13/00*** | (2006.01) |
| ***B01L 3/00*** | (2006.01) |
| ***B01F 15/00*** | (2006.01) |
| ***B01F 15/02*** | (2006.01) |
| ***B65D 81/32*** | (2006.01) |
| *B01L 3/02* | (2006.01) |

(52) U.S. Cl.

CPC ..... *B65D 83/0033* (2013.01); *B01F 13/0023* (2013.01); *B01L 3/52* (2013.01); *B01F 15/0087* (2013.01); *B01F 15/0237* (2013.01); *B65D 81/325* (2013.01); *B65D 81/3255* (2013.01); *B65D 81/3277* (2013.01); *B01L 3/527* (2013.01); *B01L 3/0217* (2013.01); *B01L 2300/0832* (2013.01); *B01L 2300/0867* (2013.01)

USPC ..... 222/135; 222/137; 222/145.1; 222/145.5; 222/326; 222/386; 222/542; 604/82; 604/191

(58) Field of Classification Search

USPC ..... 222/135–137, 145.5–145.6, 145.1, 386, 222/326–327, 542; 604/82, 191

See application file for complete search history.

(56) References Cited

U.S. PATENT DOCUMENTS

| | | | | |
|---|---|---|---|---|
| 3,570,719 | A * | 3/1971 | Schiff | 222/137 |
| 4,040,420 | A | 8/1977 | Speer | |
| 4,610,666 | A | 9/1986 | Pizzino | |
| 4,690,306 | A * | 9/1987 | Staheli | 222/80 |

(Continued)

OTHER PUBLICATIONS

Environmental Fast Facts; Semivolative Organic Reference Materials US EPA Method 8270D/8270C and Appendix IX Target Compounds, Catalog, 2007, Restek Corporation.

(Continued)

*Primary Examiner* — Frederick C Nicolas

(74) *Attorney, Agent, or Firm* — McNees Wallace & Nurick LLC

(57) ABSTRACT

A dispensing device is disclosed having an ampoule with at least four storage lumens extending axially along the length of an ampoule body, a mixing tip coupled to a distal end of the storage lumens, the mixing tip having at least four gasket seats formed therein, each gasket seat corresponding to one of the storage lumens, and an outlet lumen in fluid communication with the storage lumens.

16 Claims, 12 Drawing Sheets

(56) References Cited

U.S. PATENT DOCUMENTS

| | | | | |
|---|---|---|---|---|
| 4,913,553 | A * | 4/1990 | Falco | 366/129 |
| 4,993,594 | A * | 2/1991 | Becker et al. | 222/48 |
| 5,253,785 | A * | 10/1993 | Haber et al. | 222/43 |
| 5,476,449 | A | 12/1995 | Richmond | |
| 5,505,704 | A * | 4/1996 | Pawelka et al. | 604/191 |
| 5,566,860 | A * | 10/1996 | Schiltz et al. | 222/94 |
| 5,704,918 | A | 1/1998 | Higashikawa | |
| 5,720,731 | A * | 2/1998 | Aramata et al. | 604/191 |
| 5,810,885 | A * | 9/1998 | Zinger | 606/213 |
| 6,192,194 | B1 * | 2/2001 | Fuss et al. | 396/6 |
| 6,458,095 | B1 * | 10/2002 | Wirt et al. | 604/82 |
| 6,719,729 | B2 * | 4/2004 | Sogaro | 604/191 |
| 6,820,506 | B2 | 11/2004 | Kipke et al. | |
| 6,915,713 | B2 | 7/2005 | Kipke et al. | |
| 7,077,827 | B2 | 7/2006 | Greenfield | |
| 7,081,107 | B2 | 7/2006 | Kito et al. | |
| 7,311,692 | B2 | 12/2007 | Kato et al. | |
| 7,331,941 | B2 | 2/2008 | Vetter et al. | |
| 7,395,948 | B2 * | 7/2008 | Kogan | 222/136 |
| 7,635,343 | B2 | 12/2009 | McIntosh et al. | |
| 7,645,267 | B2 | 1/2010 | Vetter et al. | |
| 7,776,012 | B2 | 8/2010 | Felix-Faure | |
| 7,935,078 | B2 | 5/2011 | Horita et al. | |
| 7,951,108 | B2 | 5/2011 | Harper et al. | |
| 7,963,937 | B2 * | 6/2011 | Pauser et al. | 604/82 |
| 7,998,120 | B2 | 8/2011 | Sano et al. | |
| 8,092,421 | B2 | 1/2012 | Seiferlein et al. | |
| 8,092,422 | B2 | 1/2012 | Seiferlein et al. | |
| 8,268,263 | B2 | 9/2012 | Campbell et al. | |
| 8,596,498 | B2 * | 12/2013 | Werner et al. | 222/136 |
| 8,631,973 | B2 * | 1/2014 | Grundler et al. | 222/137 |
| 2002/0086340 | A1 | 7/2002 | Veerapandian et al. | |
| 2004/0170533 | A1 | 9/2004 | Chu | |
| 2007/0003965 | A1 | 1/2007 | Ramsay et al. | |
| 2011/0020182 | A1 | 1/2011 | Gao | |

OTHER PUBLICATIONS

A Guide to Preparing and Analyzing Chlorinated Pesticides, Catalog, 1999, Restek Corporation.

Guide to Preparing and Analyzing Semivolatile Organic Compounds, Catalog, 2002, Restek Corporation.

Development and Use of Reference Materials and Quality Control Materials, Report, 2003, IAEA-TECDOC-1350, International Atomic Energy Agency (IAEA), Vienna, Austria.

Calibration Curves: Program Use/Needs, Oct. 2010, Forum on Environmental Measurements.

Christopher Cox; John Lidgett; Joe Moodler, Stability of Semi-Volatile Compounds in US EPA Method 8270 and Appendix IX Analytical Reference Materials, Presentation, 2001, Restek Corporation.

Gary Stidsen; Frank Dorman; Jarl Snider, Fast Analysis of Semi-Volatile Compounds: US EPA Method 8270, PResentation, 2001, Restek Corporation.

Method 8270D Semivolatile Organic Compounds by Gas Chromatography/Mass Spectrometry (GC/MS), Feb. 2007, Revision 4, US Environmental Protection Agency.

8270 MegaMix Standard, Catalog, Catalog #31850, Restek Corporation, 2011.

Appendix A to Part 136 Methods for Organic Chemical Analysis of Municipal and Industrial Wastewater Method 624—Purgeables, Jul. 2007, US Environmental Protection Agency.

Volatiles MegaMix Standard, EPA Method 624 (26 Components), Catalog, Catalog #30497, Restek Corporation, 2010.

M.C. Pirrung, The Synthetic Organic Chemist's Companion, 2007, pp. 11-12, John Wiley & Sons, Inc.

Deactivating Glassware with DMDCS, Catalog, 2005, Catalog #31840, Publication #400-00-03, 2005, Restek Corporation.

PCT International Search Report, 11 pages, Apr. 17, 2014.

* cited by examiner

DISPENSING DEVICE

CROSS-REFERENCE TO RELATED APPLICATION

This application claims the benefit of U.S. Provisional Application No. 61/652,045, filed May 25, 2012, and U.S. Provisional Application No. 61/652,714, filed May 29, 2012.

FIELD OF THE INVENTION

The present invention is directed to methods and devices for dispensing liquids. More particularly, the present invention is directed to methods and devices for dispensing multiple liquids separately stored within a single container.

BACKGROUND OF THE INVENTION

Analytic reference materials are used as standards in chemical analysis for determining the presence and/or quantity of a particular substance or analyte. Often, the analytic reference materials are contained in glass ampoules that are hermetically sealed. The ampoules must be broken in order to access the analytic reference materials, which are then usually withdrawn with a pipette or syringe rather than being poured. The use of ampoules can suffer from various drawbacks, including that ampoules can be difficult to open, can result in and/or contaminate a sample with shattered glass, and can be time consuming to empty, among others.

Most analytic reference materials are complex combinations containing many different chemical components. Certain analytic reference materials require multiple chemical compounds of known chemical incompatibility. Placing chemically incompatible compounds in the same ampoule causes denaturing and degradation of those compounds. The denatured compounds change an analytic reference materials' chemical composition, leading to inaccurate chemical analysis. Therefore, chemically incompatible combinations are often supplied in a kit having multiple ampoules in order to keep the materials in pristine form until use. This problem is compounded by increasingly complex analytical methods that require an increasing number of components to make up the analytic reference material, resulting in so called "mega" mixes that contain a large number of individual ampoules in an analysis kit. Each ampoule contains a single analytic reference material or a combination of chemically compatible analytic reference materials. The kits require the end user to combine the contents of the ampoules, in correct amounts, to form the final analytic reference materials. These kits suffer from various drawbacks, including the large number of ampoules which must be combined to form a standard solution. The ampoules are time consuming to combine, and are prone to end user error during combination. User error, along with chemical degradation, can lead to undesirable chromatographic peaks or other errors in the data collected from various analytical techniques.

Fluids are also sometimes stored in pre-filled syringes, but which typically contain a single liquid in each syringe. In general, two individual syringes, each with their own plunger, can be held together and directed to a single output. However, those devices are difficult to handle, are difficult to depress simultaneously, present size constraints, and cannot easily incorporate more than two syringes.

In other devices, multiple liquids are held in series within a single syringe, so that as a plunger is depressed, the liquids are released one after the other. These devices suffer from their own attendant drawbacks, including that they are not capable of releasing multiple liquids at the same time and are limited by the length of the syringe.

Devices and methods for dispensing multiple liquids not suffering from the above drawbacks would be desirable in the art.

BRIEF DESCRIPTION OF THE INVENTION

In one exemplary embodiment, a device for dispensing liquid material comprises an ampoule having at least four storage lumens extending axially along the length of an ampoule body and a mixing tip coupled to a distal end of the storage lumens. The mixing tip has at least four gasket seats formed therein, each gasket seat corresponding to one of the storage lumens. The device also includes an outlet lumen in fluid communication with the storage lumens via the mixing tip.

In another exemplary embodiment, a device for dispensing liquid material comprises an ampoule having at least four storage lumens formed therein extending axially along the length of an ampoule body, a mixing tip coupled to a distal end of the ampoule body, the mixing tip having a mixing channel and a plurality of gasket seats, each gasket seat aligned with one of the storage lumens. The device also comprises a plunger assembly coupled to a proximal end of the ampoule, the plunger assembly having at least four pistons. The pistons are associated with corresponding storage lumens and are receivable therein. An analytic reference material subunit is provided in each of the storage lumens, the analytic reference material subunit sealed between a proximal gasket and a distal gasket slidably disposed within the storage lumens. When the distal gasket is seated in the gasket seat, the mixing channel fluidly connects the analytic reference material subunits of the storage lumens to the outlet lumen.

In another exemplary embodiment, a method of providing an analytic reference material is provided employing multi-lumen ampoule devices described herein.

In one exemplary embodiment, a dispensing method includes providing a dispensing device comprising an ampoule having at least two storage lumens extending axially along the length of an ampoule body, an analytic reference material subunit in each of the storage lumens, distal gaskets sealing the analytic reference material subunits from a distal end of the ampoule, and an outlet lumen. The method further includes providing a plunger assembly coupled to a proximal end of the ampoule, the plunger assembly in communication with the storage lumens and depressing the plunger assembly to force the distal gaskets into gasket seats in the dispensing device and expelling the analytic reference material subunits from the storage lumens via the outlet lumen.

The dispensing devices described herein include an ampoule having a plurality of lumens that act as isolated containers for analytic reference material subunits, to ensure chemically incompatible compounds composing an analytic reference material standard solution are not stored together. Exemplary embodiments are also capable of equivalently delivering the analytic reference material subunits as a single mixture at or just prior to the point of use.

The multi-lumen design of the device provides a way for keeping the components separate through the use of gaskets that can be moved from the fluid flow path during dispensing to be received in gasket seats. This allows the analytic reference material subunits to flow past the gaskets and combine in a common mixing channel, before exiting the ampoule. As a result, a single step both mixes and dispenses the analytic reference material standard solution, greatly reducing the number of steps required of the end user, and eliminating the risk of error commonly associated with multiple liquid transfers.

Embodiments of the present disclosure, in comparison to methods and products not utilizing one or more features disclosed herein, require less time for use, are less prone to user error, have a lower risk of contamination, and have a lower risk of broken glass.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

It has been attempted to use like reference numbers throughout the drawings to represent like parts.

DETAILED DESCRIPTION OF THE INVENTION

Figure 1:
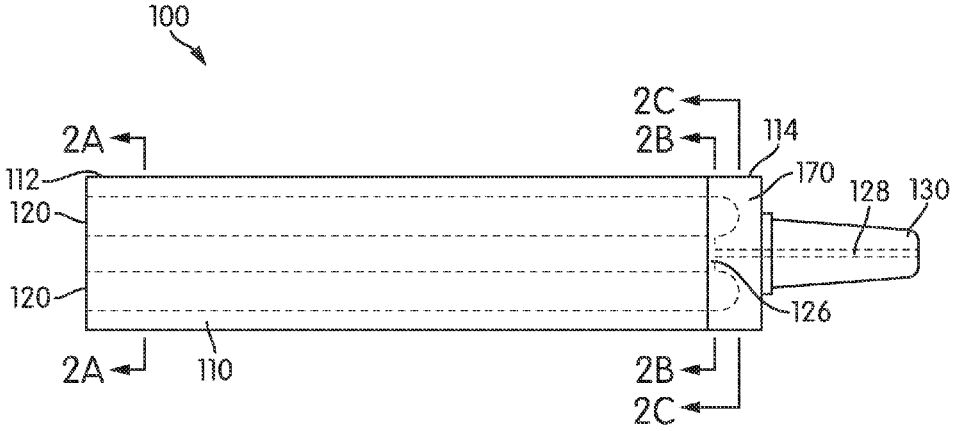
FIG. 1 is a side view of an exemplary ampoule according to an embodiment of the disclosure.

Referring to FIG. 1, an ampoule 100 includes an ampoule body 110 and a plurality of storage lumens 120 formed therein extending axially along the length of the body 110. The ampoule 100 has a proximal end 112 and a distal end 114. A connecting portion 130 extends outwardly from the distal end 114. The connecting portion 130 optionally connects to a hollow syringe needle (not shown) or other device or conduit through which the contents of the ampoule 100 are expelled and its shape is configured accordingly. The ampoule body 110 may be manufactured from any suitable material and may advantageously be formed of borosilicate glass. It will be appreciated, however, that other glass and plastic materials may also be employed. Depending on the materials of construction and/or the intended contents of the ampoule, the inner, outer or both surfaces of the ampoule 100, and particularly the surfaces of the storage lumens 120 exposed to the ampoule contents, may be chemically deactivated or otherwise treated to reduce surface reactivity and reduce solvent adsorption prior to filling.

Figure 4:
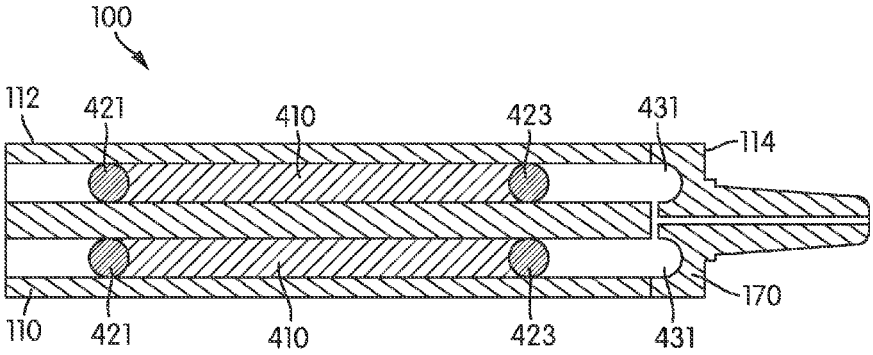
FIG. 4 is a lateral cross section view of the ampoule of FIG. 1.

Each individual storage lumen 120 houses an analytic reference material subunit 410 (FIG. 4). The analytic reference material subunits 410 are typically liquid and may comprise a component that is itself in liquid form or a suspension, dispersion, emulsion or solution of one or more components in a liquid carrier. The size of the storage lumens 120, including both their length and diameter, may depend upon the number of storage lumens 120 and the total volume needed for the analytical reference material subunits 410 required to make up a particular analytical reference material, as well as the overall ease of use of the dispensing device. The storage lumens 120 are preferably cylindrical and typically have a diameter of about 0.01 inches up to about 0.5 inches.

Although described herein primarily with respect to analytic reference materials, it will be appreciated that exemplary embodiments are contemplated for, and equally effective for use in, other applications in which two or more fluids are preferably isolated prior to mixing, but conveniently can be collectively stored and subsequently delivered to the same point of use. For example, the multilumen ampoule 100 may be used for liquid medicaments, pigments, chemical additives, and adhesives, all by way of example.

The analytic reference material subunit 410 in each individual storage lumen 120 is isolated from each of the other plurality of storage lumens 120 prior to reaching a mixing channel 126, in which the individual storage lumens 120 combine. The lumens 120 terminate at gasket seats 431, which provide space at the distal end of the storage lumens 120 to receive distal gaskets 423 as discussed subsequently in further detail with respect to FIG. 4. For convenience in manufacturing, the mixing channel 126 and gasket seats 431 of the ampoule may be constructed as part of a separate piece that is a mixing tip 170 that can be subsequently attached to the ampoule body 110.

The mixing channel 126 is also in fluid communication with an outlet lumen 128. The outlet lumen 128 provides a path for the analytic reference material subunits 410 (or other contents of the ampoule 100) to leave the mixing channel 126 and exit the ampoule 100. It will be appreciated that the mixing channel 126 and outlet lumen 128 may optionally be omitted entirely, with direct expulsion of the storage lumen contents 120 directly into a separate mixing container.

Figure 2A:
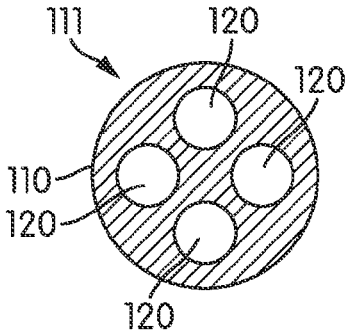
FIG. 2A is a radial cross section view showing a proximal end of an exemplary ampoule having four storage lumens according to an embodiment of the disclosure.
Figure 2B:
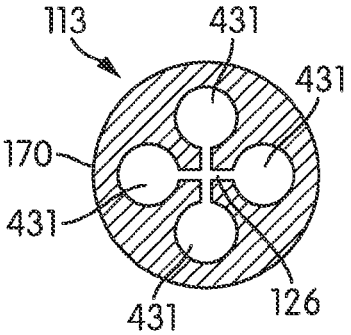
FIG. 2B is a radial cross section view showing a mixing channel of an exemplary ampoule having four storage lumens according to an embodiment of the disclosure.
Figure 2C:
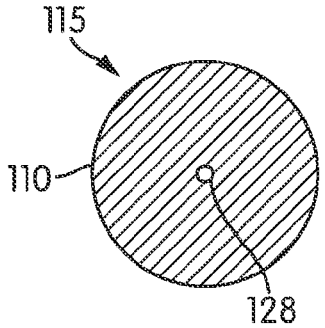
FIG. 2C is a radial cross section view showing a distal end of an exemplary ampoule having four storage lumens according to an embodiment of the disclosure.
Figure 3A:
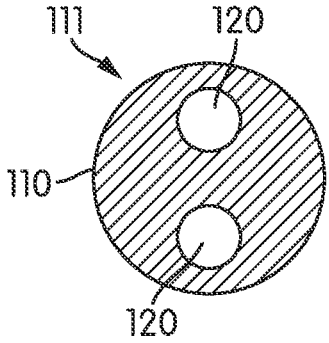
FIG. 3A is a radial cross section view showing a proximal end of an exemplary ampoule having two storage lumens according to an embodiment of the disclosure.
Figure 3B:
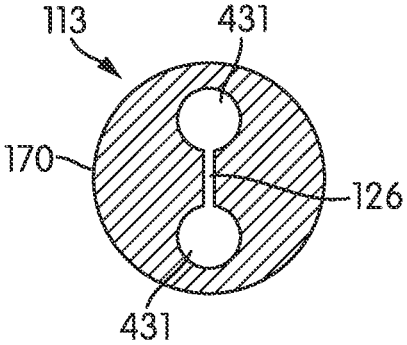
FIG. 3B is a radial cross section view showing a mixing channel of an exemplary ampoule having two storage lumens according to an embodiment of the disclosure.
Figure 3C:
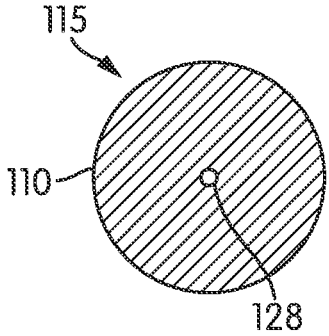
FIG. 3C is a radial cross section view showing a distal end of an exemplary ampoule having two storage lumens according to an embodiment of the disclosure.

A proximal end radial cross section 111, a mixing channel radial cross section 113 and a distal end radial cross section 115 are represented in FIG. 2A, FIG. 2B and FIG. 2C, respectively. Although illustrated with respect to four lumens, it will be appreciated by those skilled in the art that the ampoule is not limited to four lumens. In one embodiment, illustrated in FIG. 3A, FIG. 3B and FIG. 3C, the ampoule 110 may comprise as few as two storage lumens 120, while in other embodiments, the ampoule 110 may contain any other number of storage lumens 120, such as six, eight, ten, twelve, fourteen or sixteen storage lumens 120.

In many cases, certain chemical components used in analytic reference material solutions are chemically benign with respect to each other and may be present in the same solvent with no ill effects. In this case it is not always necessary to employ an ampoule having the same number of lumens as there are chemical compounds in the analytic reference material standard solution; the minimum number of discrete ampoule lumens is preferably greater than the smallest number of analytic reference material solution subunits necessary to minimize or eliminate unwanted component-component chemical interactions.

Returning to FIG. 1, the ampoule 100 contains four storage lumens 120 radially off-set toward a central point. The storage lumens 120 are within the ampoule body 110, as shown in the cross-sectional view of FIG. 2A, while the mixing channel radial cross-section 113 in FIG. 2B illustrates the cross-sectional view at the ampoule body 110/mixing tip 170 interface looking toward the mixing channel 126 and gasket seats 431 as described subsequently in more detail. The four storage lumens 120 are each coupled to the mixing channel 126, which converges to the outlet lumen 128, as shown in FIG. 2C, in which the distal end radial cross section 115 includes the outlet lumen 128 in a center portion of the ampoule body 110.

Turning to FIG. 4, a lateral cross-section of the ampoule 100 having four storage lumens 120 is illustrated in which an analytic reference material subunit 410 is shown within each storage lumen 120. While illustrated here as having the same volume, as one skilled in the art may appreciate, each storage lumen 120 may contain a different volume of analytic reference material subunit 410 depending upon the requirements of the final analytic reference material. Each analytic reference material subunit 410 is sealed on the proximal end 112 of each storage lumen 120 by a proximal gasket 421, and on the distal end 114 of each storage lumen 120 by a distal gasket 423. The storage lumens 120 terminate at the distal end 114 in seats 431. The seats 431 receive the distal gaskets 423 as the analytic reference material subunits 410 are moved towards the distal end 114. It will further be appreciated that with respect to FIG. 4 and other cross-sectional views, that the different cross-hatching is for purposes of showing different elements and is not intended to refer to any specific materials of construction.

The mixing channel 126, storage lumens 120 and gasket seats 431 are configured to minimize liquid dead volume following deployment of the standard solutions. In order to ensure consistent final concentrations of the mixed solutions, the mixing channel 126 is preferably designed in a symmetrical pattern so that the dead volumes of each individual solution subunit 410 retained in the ampoule are equivalent.

The proximal gaskets 421 and the distal gaskets 423 are of any suitable size, shape and construction and include any solid object that is sealably inserted and slidably disposed within the storage lumen 120. It will be appreciated that the characteristics of the proximal gaskets 421 may be the same or different from those of the distal gaskets 423 and further that the characteristics of all distal (or proximal) gaskets 423 are also not necessarily the same, for example, in the event that one storage lumen 120 has a diameter larger than that of another.

Preferably, the gaskets 421, 423 are constructed of an inert material or are otherwise treated so as not to react with the components of the analytic reference material subunits 410 they contain. Exemplary materials include semi-pliable materials having non-reactive surfaces, such as polyether ether ketone (PEEK), hard silicone, fluoropolymers, and particularly PTFE. The distal gaskets 423 are typically spherical or otherwise have a rounded surface, which can aid in the smooth transition of liquid from the storage lumens 120 to the mixing channel 126 when the distal gasket 423 is seated in the gasket seat 431.

In one embodiment, the proximal and distal gaskets 421, 423 are both made of Teflon, have a spherical shape and are slightly larger in diameter than the storage lumens 120. In this manner, the proximal gaskets 421 and distal gaskets 423 are sized with respect to the storage lumen to provide enough force on the storage lumen 120 to seal it and prevent the analytic reference material subunits 410 from leaking. However, the proximal gaskets 421 and distal gaskets 423 are still slidably disposed within the storage lumens 120 to be moved when a pressure is applied, which may vary depending on a variety of factors, including the elastic modulus of the material used for the gasket and/or the ampoule body 110. For example, in one embodiment, Teflon balls having a diameter of 0.0625 inches can be used as proximal and distal gaskets 421, 423 in a storage lumen 120 having a diameter of 0.0600 inches.

It is preferred, but not required, that the entire space within the storage lumen 120 between the proximal and distal gaskets 421, 423 is completely filled with the particular analytical reference material subunit 410 and is free of air gaps or bubbles. The storage lumens 120 may be filled with the analytical reference material subunits 410 during manufacture either manually, such as by using a hand-held syringe, or through automated processing techniques.

A plunger assembly provides a mechanism by which the solution subunits 410 are expelled from the storage lumens and ultimately from the ampoule 100. Any mechanism for achieving this result may be employed. In presently preferred embodiments, the plunger assembly may be configured to use mechanical force, such as pistons or other mechanical devices, to directly contact the proximal gaskets 421 as will be described subsequently. In other embodiments, the plunger assembly may be configured to use pneumatic or hydraulic pressure.

Figure 5:
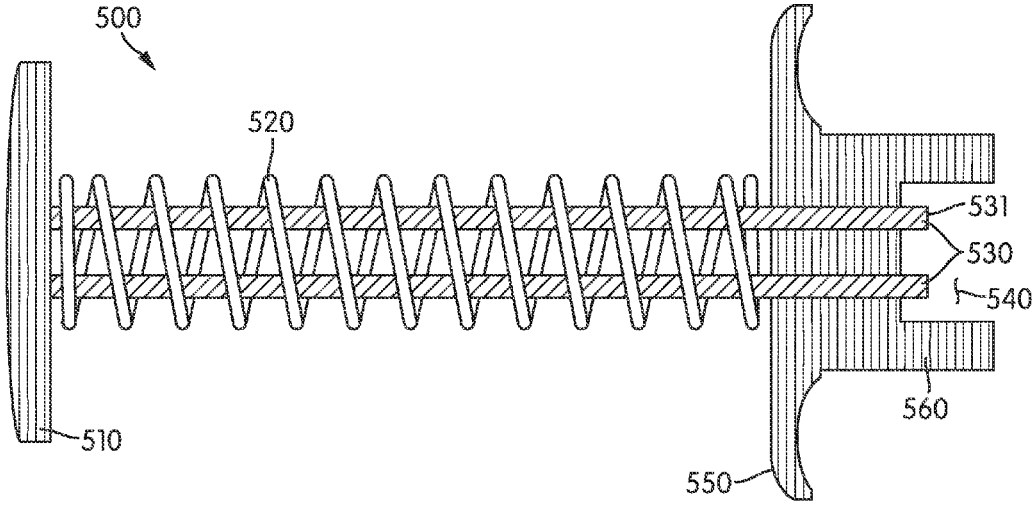
FIG. 5 is a side view of an exemplary plunger assembly according to an embodiment of the disclosure.

Turning to FIG. 5, a plunger assembly 500 is extended through a plunger-ampoule interface dock 560 that can be actuated to mechanically expel the individual solution subunits 410 from the ampoule 100. In one embodiment, the plunger assembly 500 includes plunger plate 510 coupled to a piston array 530 having a plurality of pistons 531. The pistons 531 extend through the plunger-ampoule interface dock 560 and into an ampoule retaining portion 540. A radially extending flange 550 extends outwardly from the plunger-ampoule interface dock 560. The radially extending flange 550 provides a grip for a user. A plunger spring 520 (not shown in cross-section for purposes of illustration) maintains the plunger assembly 500 in a relaxed state.

Figure 6A:
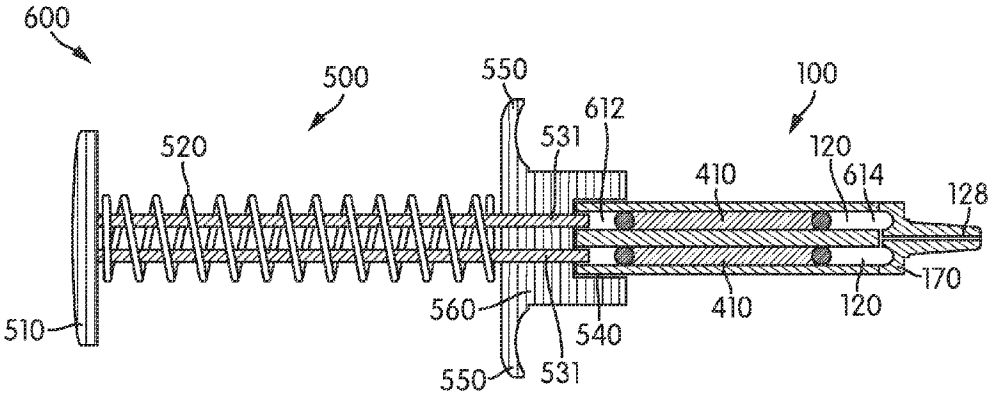
FIGS. 6A-6D are schematic side views of an exemplary dispensing device according to an embodiment of the disclosure at various stages of plunger depression.
Figure 6B:
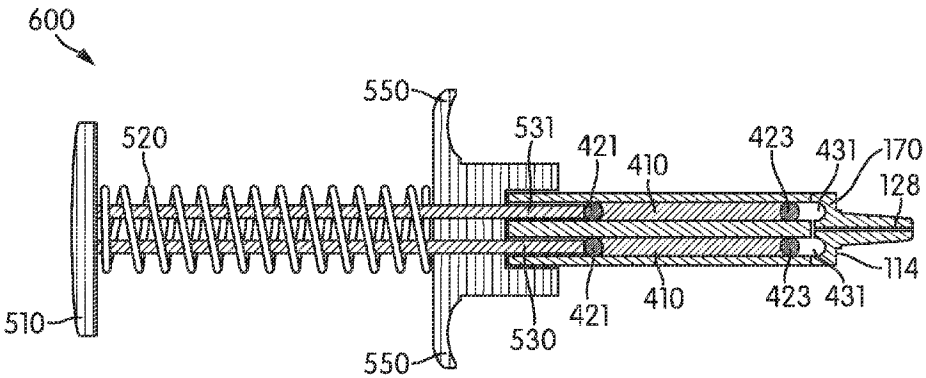
Figure 6C:
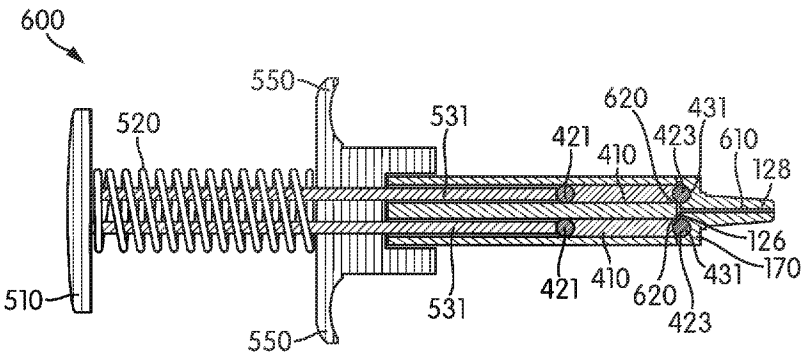

Referring now to FIGS. 6A-6D, a dispensing device 600 in accordance with an exemplary embodiment is shown in various steps of use as the plunger assembly 500 is depressed (with the ampoule 100 shown in lateral cross-section for purposes of illustration). The dispensing device 600 includes the ampoule 100 coupled to the plunger assembly 500. The ampoule 100 is positioned within the ampoule retaining portion 540 of the plunger-ampoule interface dock 560. The plunger-ampoule interface dock 560 engages the ampoule 100 and aligns the storage lumens 120 with the pistons 531. The number of pistons 531 on the plunger assembly 500 corresponds to the number of storage lumens 120 in the ampoule 100. Each storage lumen 120 receives a single piston 531 at the proximal end 112. In a fully extended position (as seen in FIG. 6A), the pistons 531 are within the storage lumens 120 of the ampoule 100 in the retaining portion 540.

Specifically referring to FIG. 6A, the plunger assembly 500 is fully relaxed, with an initial proximal dead space 612 in the storage lumens 120. The proximal dead space 612 is an open area of the storage lumens 120 between the pistons 531 and the proximal gaskets 421. A distal dead space 614 is also present in the storage lumens 120. The distal dead space 614 is an open area of the storage lumens 120 between the distal gaskets 423 and the seats 431. The proximal dead space 612 and the distal dead space 614 allow for any thermal expansion of the analytic reference material subunits 410 within the storage lumens 120 that may occur during transport or storage. The proximal dead space 612 and the distal dead space 614 are typically occupied by a gas or liquid, but can be occupied by any substance or combination of substances allowing for thermal expansion.

Figure 7A:
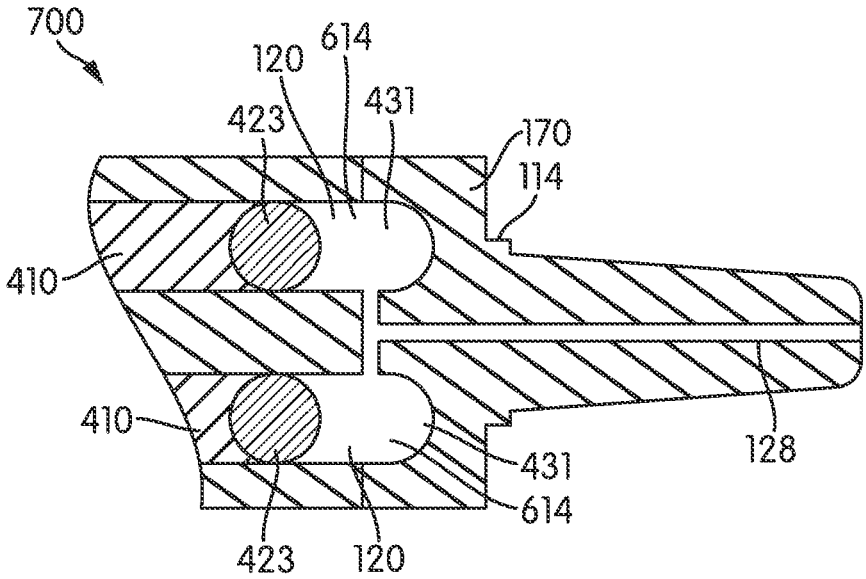
FIG. 7A is a lateral cross-sectional view of the distal end of the device according to an embodiment of the disclosure showing the mixing tip prior to fluid expulsion.

As the plunger plate 510 is depressed (FIG. 6B), the plunger spring 520 is compressed, the pistons 531 slide axially further into the storage lumens 120, contacting the proximal gaskets 421. The pistons 531 displace the proximal dead space 612 and move the analytic reference material subunits 410, and the distal gaskets 423, towards the distal end 114 (as seen better in the enlarged view of FIG. 7A).

Figure 7B:
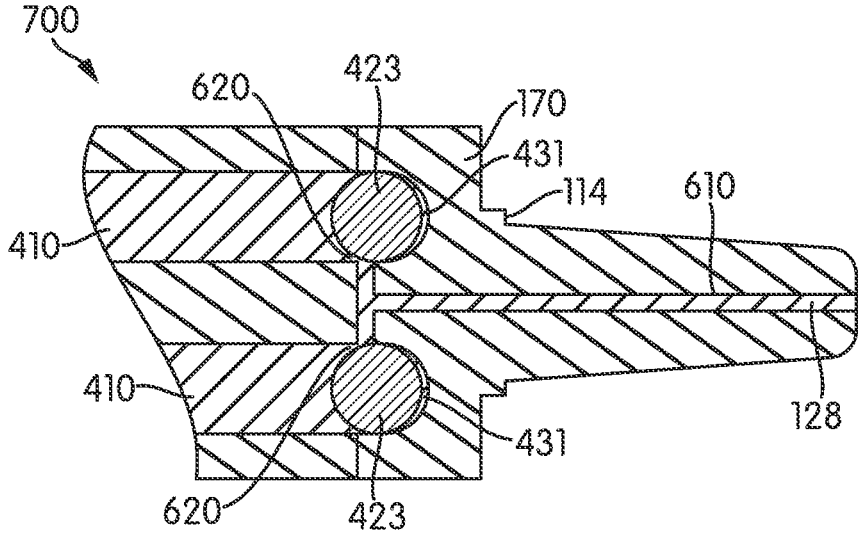
FIG. 7B is a lateral cross-sectional view of the distal end of the device according to an embodiment of the disclosure showing the mixing tip during fluid expulsion.

As the plunger plate 510 is further depressed (FIG. 6C), the pistons 531 slide further into the storage lumens 120. The pistons 531 push the proximal gaskets 421 which in turn push the analytic reference material subunits 410. The analytic reference material subunits 410 push the distal gaskets 423 past the mixing channel 126 and into the gasket seats 431. A mixing channel gap 620 (as better seen in FIG. 7B) is formed between the distal gaskets 423 and the mixing channel 126. The mixing channel gap 620 allows analytic reference material subunits 410 to flow past the distal gaskets 423 and into the mixing channel 126. In the mixing channel 126, the analytic reference material subunits 410 combine to form a combined stream 610. The combined stream 610 flows from the mixing channel 126 into the outlet lumen 128 and is expelled from the dispensing device 600.

Figure 6D:
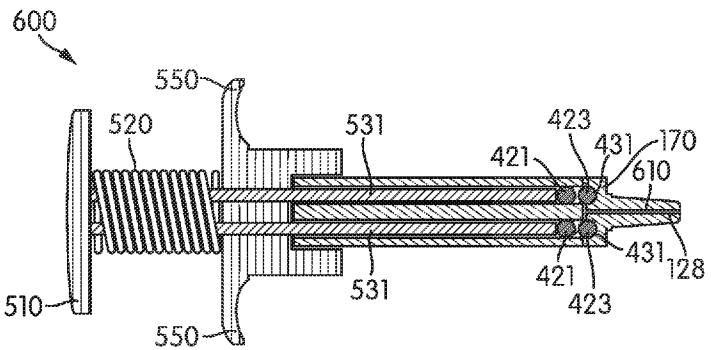

In FIG. 6D, the plunger plate 510 is fully depressed, compressing the plunger spring 520. The pistons 531 are fully deployed, pressing the proximal gaskets 421 against the distal gaskets 423. The distal gaskets 423 are fully seated in the seats 431, completely displacing the distal dead space 614 and maximizing the volume of analytic reference material subunits 410 expelled. The total expelled contents of the ampoule 100 form a predetermined analytical reference solution based upon the individual components independently included as subunits 410 in the plurality of storage lumens 120. While some volume of unexpelled analytic reference material subunits 410 will remain fugitive within the ampoule, the design generally ensures that it does so in a manner that minimizes that volume and that retains the relative proportions of the analytic reference material subunits 410.

In another embodiment (FIGS. 11A-11D), a dispensing device 1100 has a plunger assembly 1150 that includes a fluid dispensing apparatus coupled to the proximal end 112 of the ampoule 100 to expel the contents of the storage lumens 420 by pneumatic or hydraulic pressure. A working fluid 1100 is extruded from the fluid dispensing device to the ampoule 100, where it enters the storage lumens 120. The working fluid contacts the proximal gasket 421 of each lumen 120, and drives the proximal gaskets 421, the analytic reference material subunits 410, and the distal gaskets 423, towards the distal end 114 of the ampoule 100 as the working fluid is further extruded. The working fluid is any suitable liquid or gas substance that preferably does not pass through the proximal gasket 421. It may be desirable to use a solvent compatible with the analytic reference material as the working fluid so that if any leakage of the working fluid beyond the proximal gasket 421 does occur, it will not contaminate the ampoule contents.

Thus, when a dispensing device 1100 of the plunger assembly 1150 is depressed (with the ampoule 100 shown in lateral cross-section for purposes of illustration), a plunger tip portion 1116 of the plunger assembly 1150 is positioned within a plunger retaining portion 1140 of the plunger-ampoule interface dock 560. The plunger assembly 1150 has an interior portion 1111 with the working fluid 1110 provided therein. A fluid driving member 1114 is coupled to the plunger plate 510 and slidably disposed within the interior portion 1111 of the plunger assembly 1150. As the plunger plate 510 is depressed, the fluid driving member 1114 forces the working fluid 1110 through the plunger tip portion 1116 into the plunger-ampoule interface dock 560 and then into the storage lumens 120 where it contacts the proximal gaskets 421. As the plunger plate 510 is further depressed, the working fluid 1110 continues to drive the gaskets 421, 423 and the analytic reference material subunits 410, until the distal gaskets 423 are seated in the gasket seats 431 in the manner described with respect to embodiments employing a mechanical plunger assembly.

Figure 8:
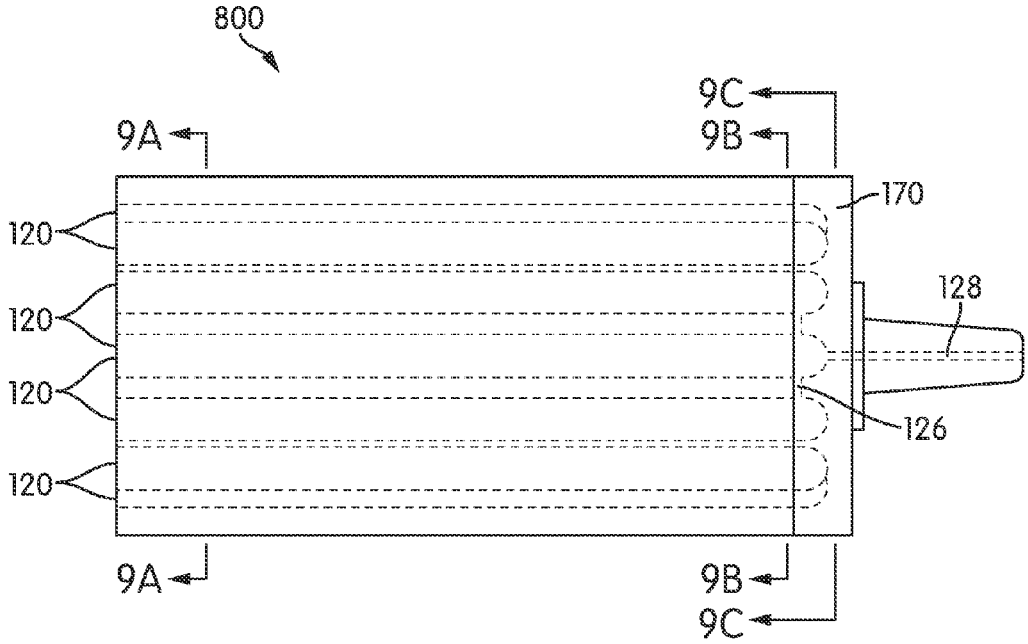
FIG. 8 is a side view of an exemplary ampoule having a plurality of lumen according to an embodiment of the disclosure having twelve storage lumens.

Turning to FIG. 8, in another embodiment, the ampoule 800 is provided having twelve lumens 120, but which otherwise operates according to the principles already described. The twelve lumens 120 are coupled to a mixing channel 126, which is coupled to an outlet lumen 128. A proximal end radial cross section 811, a mixing channel radial cross section 813 and a distal end radial cross section 815 are shown in FIG. 9A, FIG. 9B, and FIG. 9C, respectively.

Figure 9A:
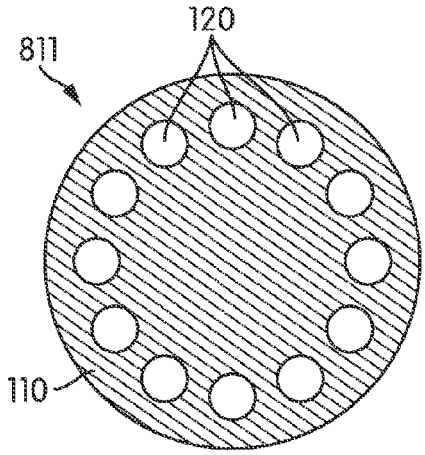
FIG. 9A is a radial cross section view showing a proximal end of an exemplary ampoule having twelve storage lumens according to an embodiment of the disclosure.
Figure 9B:
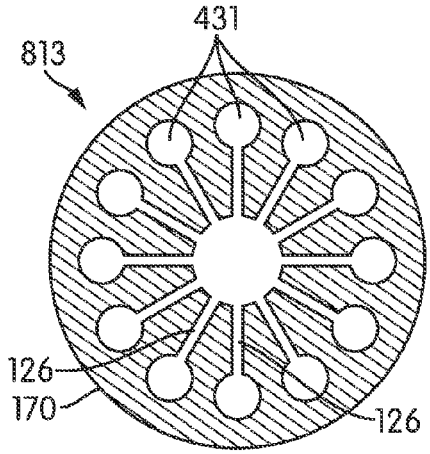
FIG. 9B is a radial cross section view showing a mixing channel of an exemplary ampoule having twelve storage lumens according to an embodiment of the disclosure.
Figure 9C:
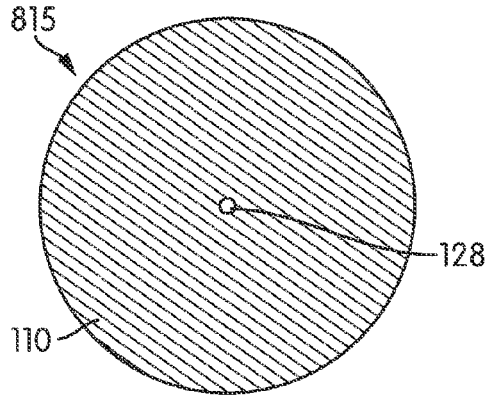
FIG. 9C is a radial cross section view showing a distal end of an exemplary ampoule having twelve storage lumens according to an embodiment of the disclosure.

Referring specifically to FIG. 9A and FIG. 9B, the proximal end radial cross section 811 is illustrated with twelve lumens 120 radially arranged about a central point of the ampoule body 110. The mixing channel radial cross section 813 has twelve storage lumens 120 coupled to the mixing channel 126. As shown in FIG. 9C, the distal end cross section 815 has the outlet lumen 128 centrally located within the ampoule body 110.

Figure 10:
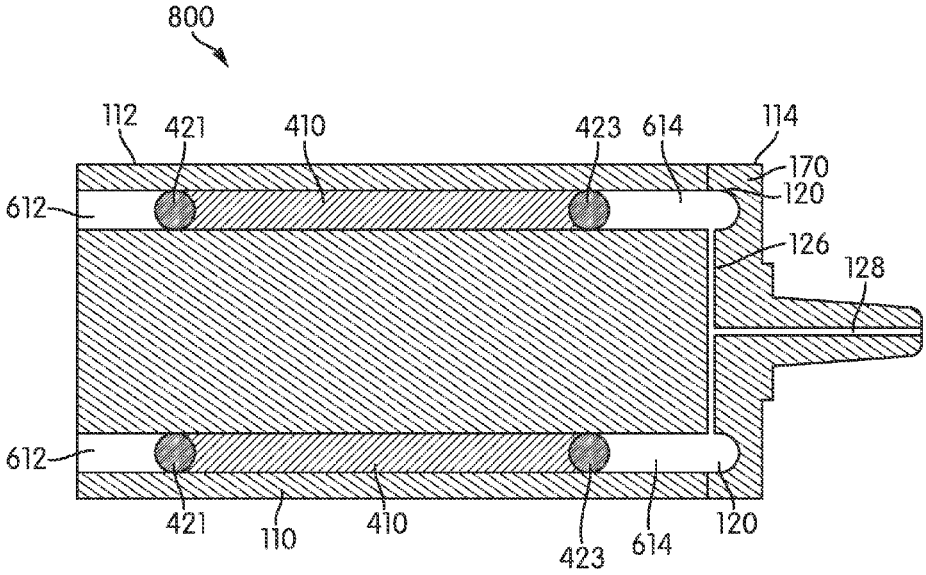
FIG. 10 is a lateral cross section view of an exemplary ampoule containing fluid according to an embodiment of the disclosure.
Figure 11A:
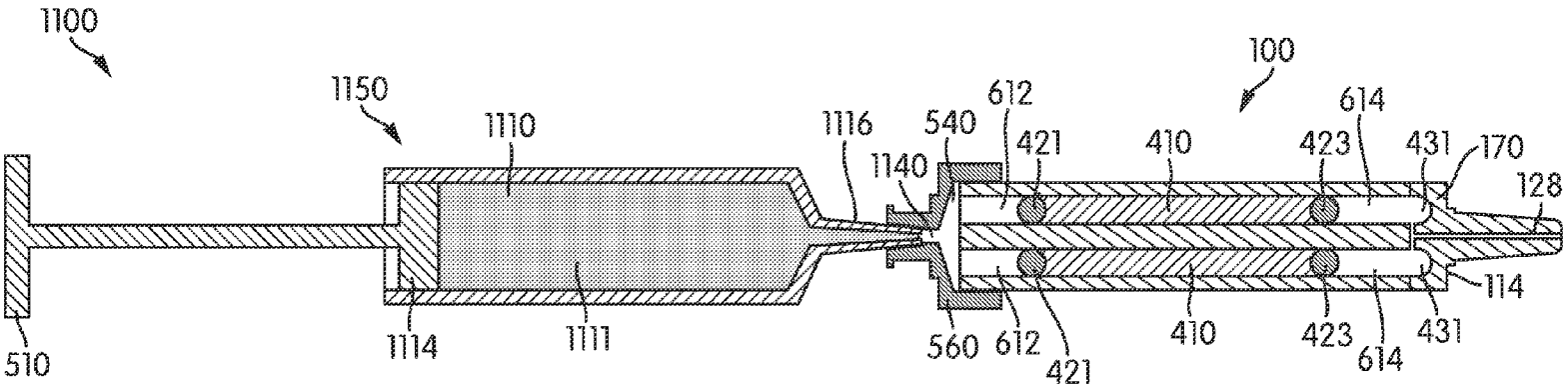
FIGS. 11A-11D are schematic side views of an exemplary dispensing device according to another embodiment of the disclosure at various stages of plunger depression.
Figure 11B:
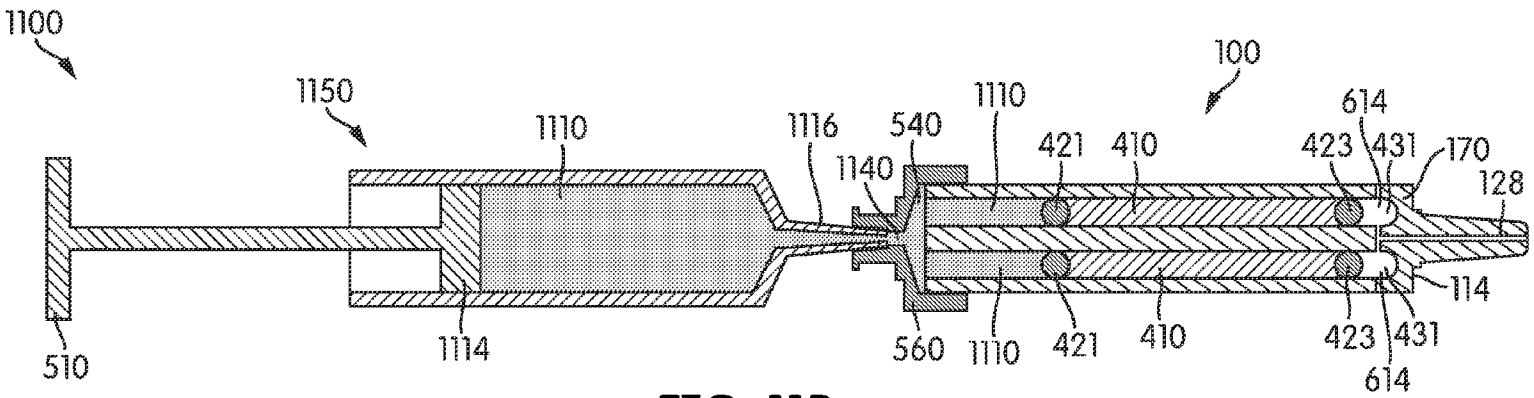
Figure 11C:
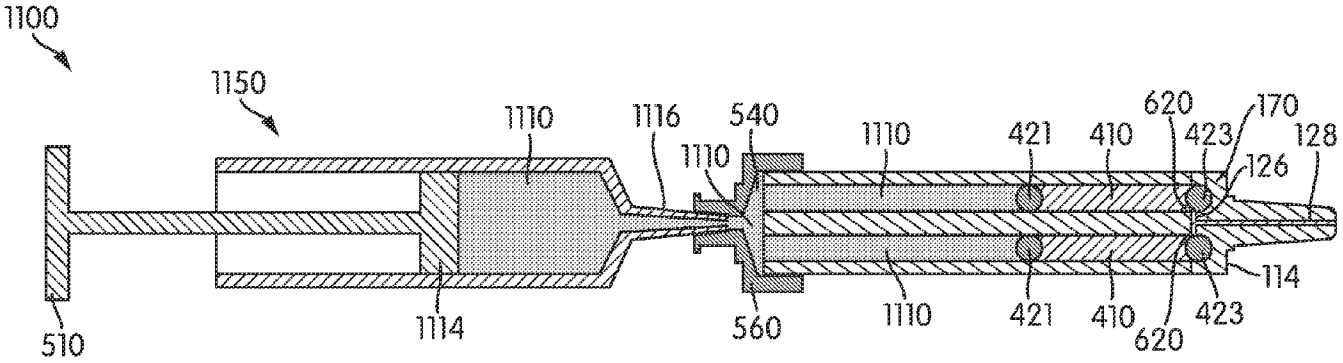
Figure 11D:
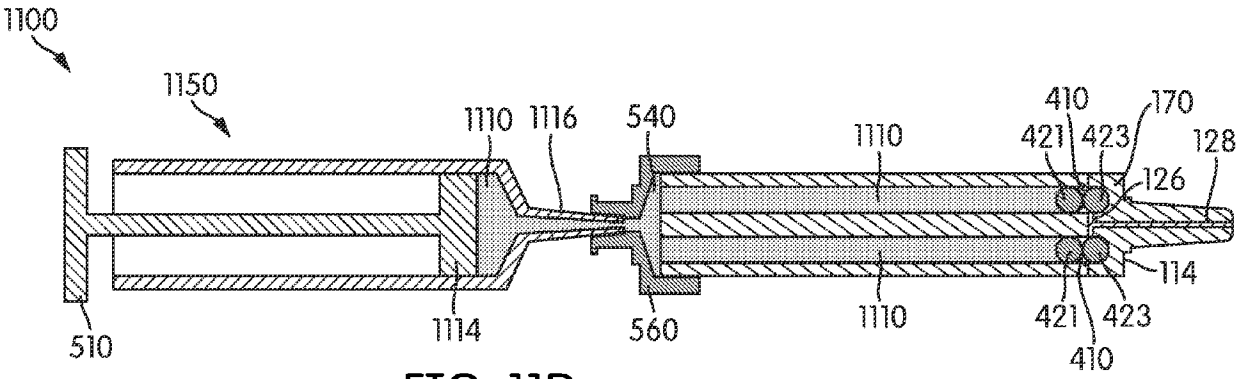

Referring now to FIG. 10, it will be appreciated that the ampoule 800 has a larger ampoule body 110 to accommodate the twelve storage lumens 120 present in this embodiment, with each of the twelve storage lumens 120 provided with an analytic reference material subunit 410. It will further be appreciated that as the number of lumens increases, it may be desirable to decrease the volume of the lumens by providing the lumens with a diameter that is less than about 0.25 inches in embodiments having twelve or more lumens.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A device for dispensing liquid material, comprising:

an ampoule having at least four storage lumens extending axially along the length of an ampoule body, the storage lumens having a diameter in the range of about 0.01 inches to about 0.25 inches;

a mixing tip coupled to a distal end of the storage lumens, the mixing tip having at least four gasket seats formed therein, each gasket seat corresponding to one of the storage lumens;

an outlet lumen in fluid communication with the storage lumens via the mixing tip; and an analytic reference material subunit provided in at least two of the storage lumens, wherein each of the storage lumens has a proximal gasket sealing the analytic reference material from a proximal end of the ampoule and a distal gasket sealing the analytic reference material from a distal end of the ampoule and wherein the proximal gasket and the distal gasket are spherical.

2. The device of claim 1, wherein a mixing channel in the mixing tip couples each of the storage lumens to the outlet lumen.

3. The device of claim 1 further comprising a plunger assembly coupled to a proximal end of the ampoule in communication with the storage lumens.

4. The device of claim 3, wherein the plunger assembly comprises at least four pistons, the pistons associated with corresponding storage lumens and receivable therein.

5. The device of claim 3, wherein the plunger assembly comprises a working fluid dispensing apparatus in fluid communication with the storage lumens.

6. The device of claim 1, wherein each of the storage lumens has a diameter equal to the others.

7. The device of claim 1, wherein each of the storage lumens are equidistant from the outlet lumen.

8. The device of claim 1, wherein at least one analytic reference material subunit is chemically incompatible with at least one other analytic reference material subunit.

9. The device of claim 1, wherein the distal gasket has a diameter larger than the diameter of its corresponding storage lumen.

10. The device of claim 1, wherein the proximal gasket and the distal gasket are constructed of polytetrafluoroethylene.

11. The device of claim 1, wherein the ampoule has at least twelve storage lumens extending axially along the length of the ampoule body, the mixing tip having at least twelve gasket seats, each gasket seat corresponding to one of the twelve storage lumens.

12. The device of claim 11, wherein each of the twelve storage lumens has a diameter equal to the others.

13. A device for dispensing liquid material, comprising:

an ampoule having at least four storage lumens having a diameter from about 0.01 inches to about 0.25 inches formed therein extending axially along the length of an ampoule body;

a mixing tip coupled to a distal end of the ampoule body, the mixing tip having a mixing channel and a plurality of gasket seats, each gasket seat aligned with one of the storage lumens;

a plunger assembly coupled to a proximal end of the ampoule, the plunger assembly having at least four pistons, the pistons associated with corresponding storage lumens and receivable therein; and an analytic reference material subunit provided in each of the storage lumens, the analytic reference material subunit sealed between a proximal gasket and a distal gasket slidably disposed within the storage lumens, wherein when the distal gasket is seated in the gasket seat, the mixing channel fluidly connects the analytic reference material subunits of the storage lumens to the outlet lumen.

14. The device of claim 13, further comprising a dead space in the storage lumens intermediate the proximal gasket and the storage lumen's corresponding piston and a dead space in the storage lumens intermediate the distal gasket and the distal gasket seat.

15. The device of claim 13, wherein a volume between the outlet lumen and each storage lumen is identical.

16. The device of claim 13, wherein the storage lumens are equidistant from the outlet lumen.

* * * * *